US009755377B2

(12) United States Patent
Kunes et al.

(10) Patent No.: US 9,755,377 B2
(45) Date of Patent: Sep. 5, 2017

(54) CONNECTOR

(75) Inventors: Mark Anthony Kunes, Hitchin (GB); Paul Thomas McMahon, Stevenage (GB)

(73) Assignee: ASTRIUM LIMITED, Hertfordshire (GB)

( * ) Notice: Subject to any disclaimer, the term of this patent is extended or adjusted under 35 U.S.C. 154(b) by 489 days.

(21) Appl. No.: 12/824,526

(22) Filed: Jun. 28, 2010

(65) Prior Publication Data

US 2011/0256759 A1 Oct. 20, 2011

(30) Foreign Application Priority Data

Apr. 16, 2010 (EP) ..... 10275042

(51) Int. Cl.

| | |
|---|---|
| ***H01R 24/40*** | (2011.01) |
| ***H01R 13/11*** | (2006.01) |
| ***H01R 43/16*** | (2006.01) |
| *H01R 13/03* | (2006.01) |
| *H01R 13/622* | (2006.01) |
| *H01R 103/00* | (2006.01) |

(52) U.S. Cl.

CPC ..... *H01R 24/40* (2013.01); *H01R 13/11* (2013.01); *H01R 43/16* (2013.01); *H01R 13/03* (2013.01); *H01R 13/111* (2013.01); *H01R 13/622* (2013.01); *H01R 2103/00* (2013.01); *Y10T 29/49204* (2015.01)

(58) Field of Classification Search

CPC ..... H01R 24/40; H01R 13/11; H01R 13/09; H01R 43/16

See application file for complete search history.

(56) References Cited

U.S. PATENT DOCUMENTS

| | | | | |
|---|---|---|---|---|
| 2,816,066 | A * | 12/1957 | Russell | 205/170 |
| 3,665,460 | A * | 5/1972 | Murakami et al. | 341/138 |
| 3,963,455 | A * | 6/1976 | Nobel et al. | 428/665 |
| 4,397,086 | A * | 8/1983 | Bickos et al. | 29/876 |
| 5,041,020 | A * | 8/1991 | Michael | 439/578 |
| 5,417,588 | A * | 5/1995 | Olson et al. | 439/585 |
| 6,109,963 | A * | 8/2000 | Follingstad et al. | 439/578 |
| 6,454,618 | B1 * | 9/2002 | Andoh et al. | 439/886 |
| 7,096,582 | B2 * | 8/2006 | Sayama et al. | 29/884 |
| 7,448,906 | B1 | 11/2008 | Islam | |
| 2007/0275584 | A1 * | 11/2007 | Keating | 439/271 |
| 2008/0014778 | A1 * | 1/2008 | Norwood et al. | 439/314 |

FOREIGN PATENT DOCUMENTS

| | | |
|---|---|---|
| WO | WO 02/13326 | 2/2002 |

OTHER PUBLICATIONS

European Search Report dated Sep. 3, 2010, issued in the corresponding European Application No. 10275042.9-1231.

* cited by examiner

*Primary Examiner* — Alexander Gilman

(74) *Attorney, Agent, or Firm* — Buchanan Ingersoll & Rooney PC

(57) ABSTRACT

A connector includes an outer connection element and an inner connection element. One of the outer connection element and inner connection element includes a plurality of fingers extending at an angle relative to a longitudinal axis of the connector.

23 Claims, 6 Drawing Sheets

CONNECTOR

The present invention relates to a connector, and in particular a TNC connector. The connector is designed to produce very low passive intermodulation distortion.

A TNC (threaded Neill-Concelman) connector is a well know for radio and wired applications. A TNC connector may be a source of passive intermodulation distortion. Intermodulation distortion is the unwanted modulation of signals containing two or more different frequencies. Due to a non-linearity in the system, each frequency component modulates the other components. A TNC connector may not behave in a linear manner, and hence cause intermodulation, due to junctions of dissimilar metals or junctions of metals and oxides. These junctions effectively form diodes, which are non-linear.

In many passive systems, intermodulation distortion is not usually noticeable. In a satellite system, in particular, a telecommunications satellite, the transmit signal power is significantly greater than the receive signal power (greater than 120 dB). It is therefore important to minimise passive intermodulation distortion, otherwise products generated by transmit carriers could fall within the receive band and cause interference.

The present invention provides, in a first aspect, a connector comprising: an outer connection element and an inner connection element; wherein one of the outer connection element and inner connection element comprises a plurality of fingers extending at an angle relative to a longitudinal axis of the connector.

The present invention provides, in a second aspect, a method of manufacturing a connector comprising: forming a connector having an outer connection element or inner connection element having fingers, wherein the fingers are formed extending parallel to a longitudinal axis of the connector unit; restraining the fingers at an angle to the longitudinal axis; and deforming the fingers to extend at an angle to the longitudinal axis.

Thus, the connector produces a very low passive intermodulation distortion.

An embodiment of the present invention will now be described, by way of example only, with respect to the following drawings, in which:

FIG. 1 is a side elevation cross-section of a plug according to the present invention;

FIG. 2*a* is a side elevation cross-section of a body forming part of the plug of FIG. 1;

FIG. 2*b* is a side elevation cross-section of part of the body of FIG. 2*a*; FIG. 3 is a side elevation cross-section of a dielectric forming part of the plug of FIG. 1;

Figure 5:
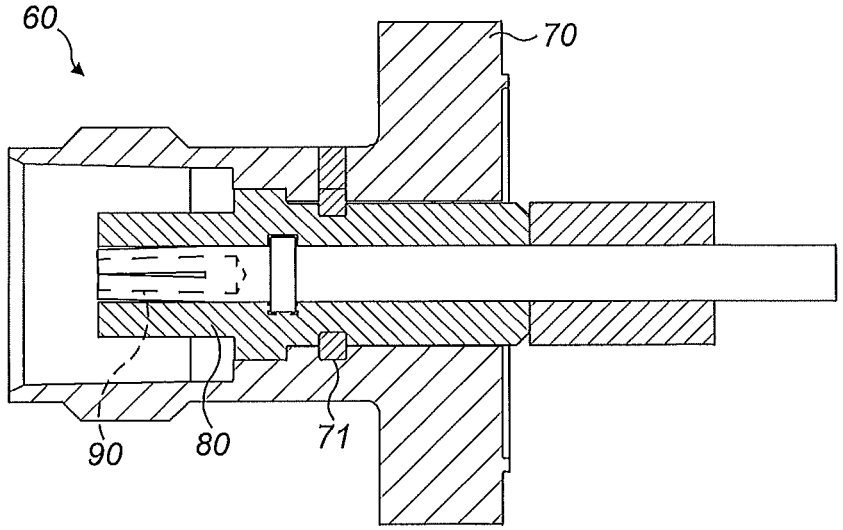
FIG. 5 is a side elevation cross-section of a socket according to the present invention.
Figure 8A:
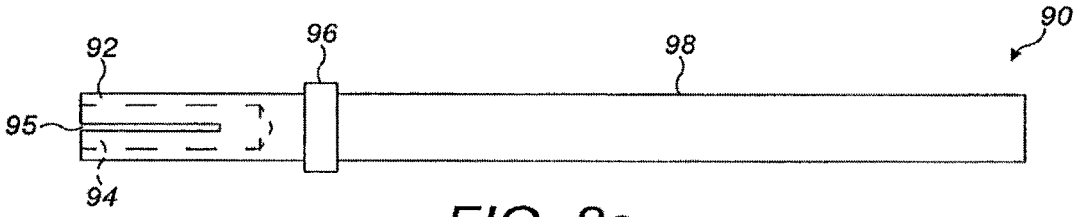
Figure 8B:
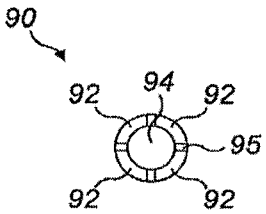

FIG. 8*a* is a side elevation cross-section of a probe forming part of the socket of FIG. 5;

FIG. 8*b* is a front elevation view of the probe of FIG. 8*a;*

Figure 1:
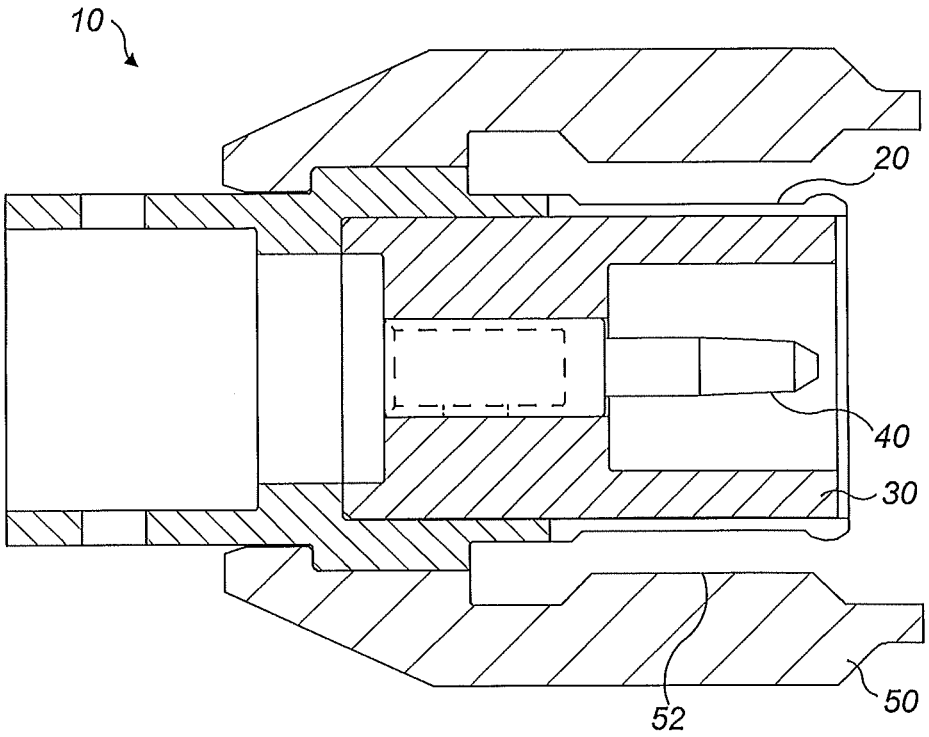
Figure 8C:
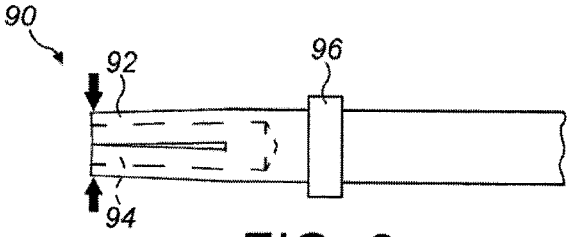
Figure 9:
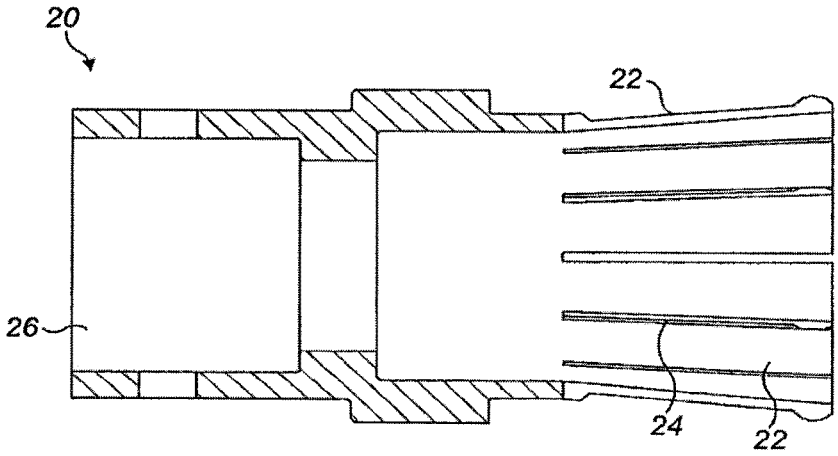
Figure 10:
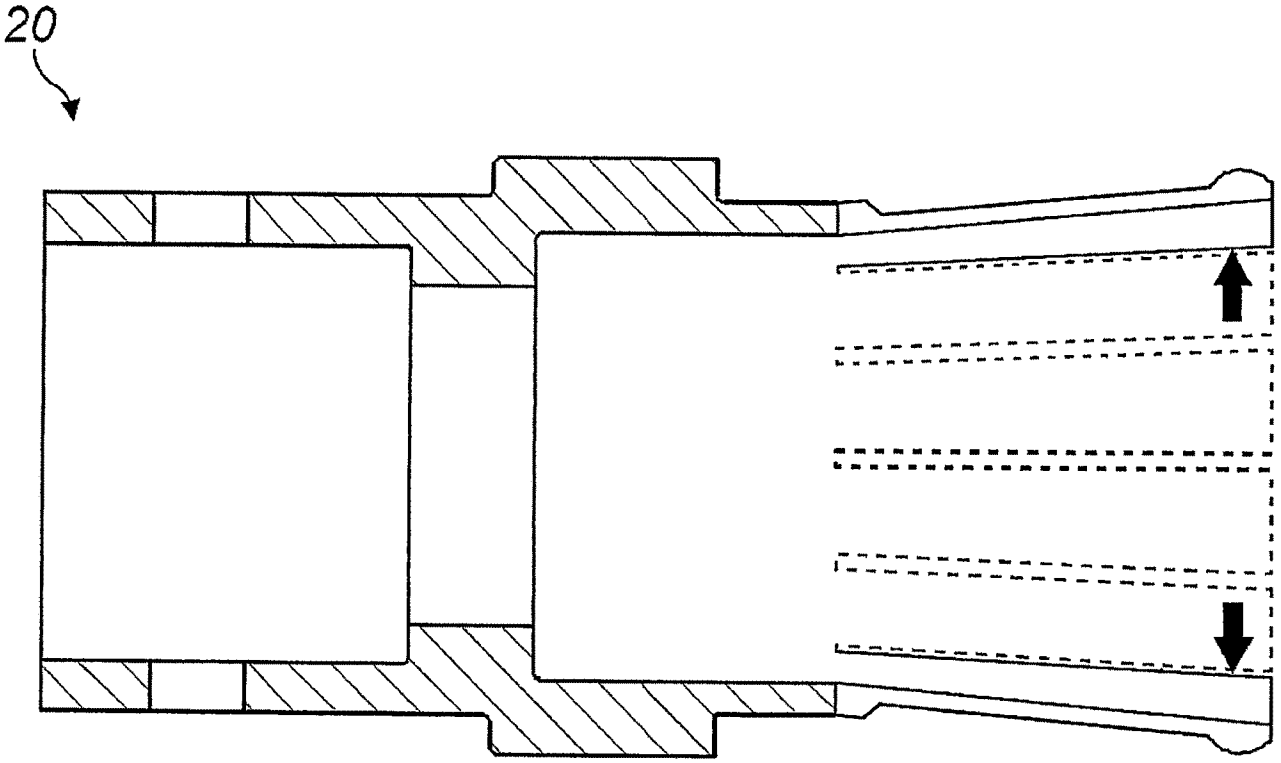

FIG. 8*c* is a side elevation cross-section of part of the probe of FIG. 8*a*, during manufacture;

FIG. 9 is a side elevation cross-section of a body forming part of the plug of FIG. 1; and FIG. 10 is a side elevation cross-section of the body of FIG. 9, during manufacture.

The present invention relates to TNC connectors, namely a plug and a socket which are connectable together. Preferably, the plug and socket of the present invention are used together. The plug and socket of the present invention are of standard size, and so may be connected to a co-operating known TNC connector.

The connectors of the present invention allow passive intermodulation (PIM) distortion levels of the order of −145 dBm $5^{th}$ order PIM at L-band frequencies (1 to 2 GHz) for two 50 W carriers. This distortion compares to typical PIM distortion of standard TNC connectors which is typically of the order of −80 dBm under the same conditions.

FIG. 1 shows a plug 10 which is a connector according to the present invention. The plug 10 may also be termed a plug connector or male connector. The plug 10 is configured to connect with a co-operating socket. The plug 10 is a TNC connector and comprises an elongate body 20 radially surrounding a dielectric 30. The dielectric 30 radially surrounds a pin 40. A coupling part 50 having a threaded section 52 is attached to the body 20. The arrangement of the plug 10 is substantially the same as a known TNC connector. The plug 10 comprises an inner connection element formed by the pin 40, and an outer connection element formed by the body 20.

Figure 2A:
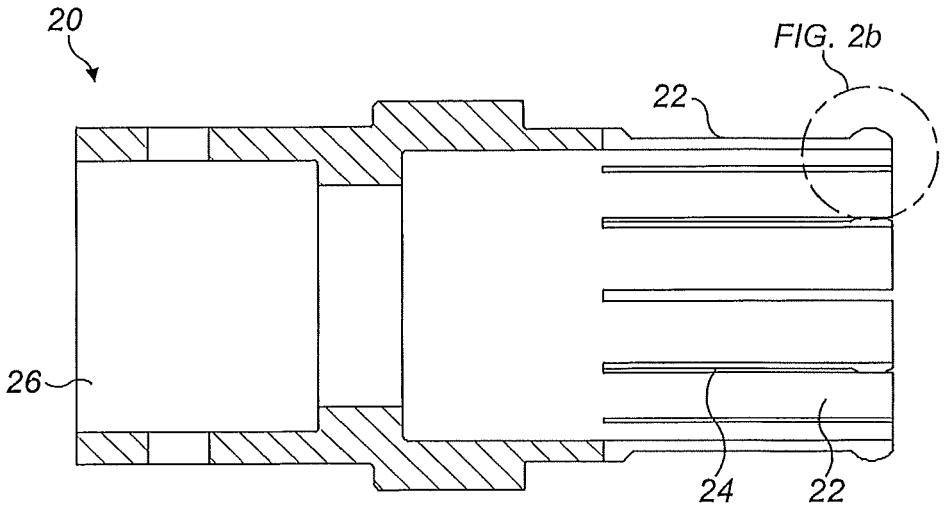

FIG. 2*a* shows the body 20 of the plug 10. The body 20 is substantially annular. Fingers 22 are formed at a first end of the body 20, forming the outer connection element and configured to contact inside an outer connection element of the socket. The fingers 22 are defined by slits 24 extending in a longitudinal direction. The slits 24 are preferably between approximately 0.2 mm and 0.3 mm, and preferably 0.25 mm and 0.275 mm in width, and extend between approximately 6.5 mm and 7.5 mm, and preferably 6.9 mm and 7.1. Preferably, there are twelve fingers 22, arranged as an annulus and equally spaced and dimensioned.

The body further comprises a cavity 26 at a second end, opposite to the first end. The cavity 26 is configured to receive and securely attach to a cable.

Figure 2B:
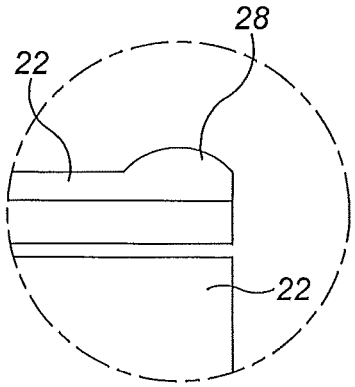

FIG. 2*b* shows an enlargement of a distal end of a finger 22, distal from the remainder of the body. The finger 22 is provided with a profiled end 28. The profiled end 28 has an enlarged cross-section relative to the remainder of the finger 22. In particular, the profiled end 28 is a protrusion on a radially outer surface of the fingers 22, and a radially inner surface of the fingers 22 is uniform along the length of the fingers 22.

The profiled end 28 is curved in a longitudinal direction, in a symmetrical arcuate curve and extends radially outwardly. The profiled ends 28 are uniform across the width of the fingers 22. The profiled ends 28 preferably have a radius of curvature of approximately between 0.5 mm and 1 mm, and preferably between 0.57 mm and 0.68 mm, centred radially inwardly of the radially inner surface of the fingers 22. The curve of the profiled ends 28 is preferably centred a distance less than the radius of curvature from the distal end of the fingers 22, such that the surface of the profiled ends comprises an arc extending through less than 180°. The centre of curvature is between 0.25 mm and 0.75 mm from the distal end of the fingers, and preferably between 0.45 mm and 0.55 mm. All of the fingers 22 are provided with such profiled ends 28.

The body 20 is formed from beryllium copper. Beryllium copper has physical characteristics which allow the fingers to be resiliently deformable, in particular, the fingers may readily deformed and return to their original configuration. The beryllium copper is plated with a layer of copper, preferably between 1 μm and 5 μm, and more preferably 2

μm±1 μm in thickness. A layer of silver plate is then applied onto the copper plate. The silver plate is between 10 μm and 30 μm, and is preferably 15 μm±5 μm in thickness. The plating thickness may have a maximum of 50 μm on corners. The plating materials and thicknesses have been selected to provide optimum conductivity. Due to the skin effect, electric current is substantially carried by the outer silver layer at microwave frequency (e.g. 1 to 2 GHz).

The fingers 22 are initially formed extending longitudinally and parallel to each other, with an internal diameter of between approximately between 6.8 mm and 7.3 mm, and preferably between 7.100 mm and 7.122 mm. During manufacture, the fingers 22 are splayed apart so that the profiled ends 28 contact an internal diameter of between 8.3 mm and 8.7 mm, and preferably 8.5 mm. A distal end of each finger may diverge from the longitudinal axis by a perpendicular distance of between 0.5 mm and 1 mm, and preferably 0.7 mm The splayed fingers 22 are restrained in this diverging position, and permanently deformed to the diverging position. Preferably, the fingers 22 are heat treated, preferably for 2 hours at 335° C.±5° C. The fingers 22 are deformed linearly along their length, such that each finger 22 is straight and orientated at an angle to the longitudinal axis of the plug. Following this treatment the fingers 22 stay in the diverging position, until forced radially inwardly by contact with the socket towards extending longitudinally. Thus, the fingers 22 extend, by being deformed, in a direction opposite to a direction in which they are urged by a co-operating connector.

The surface of the plug 10, and in particular, areas of the plug 10 configured to contact a socket, have a very uniform surface finish. The fingers 22, and in particular the profiled ends 28, have a surface finish better than 4 μm. More particularly, the surface finish is approximately, or better than, 1.2 μm. The surface finish is more preferably better than 0.4 μm, in particular on the profiled ends 28. The surface finish is preferably achieved by polishing.

The initial diverging position of the fingers 22 and the profiled ends 28 provide a very high connection pressure with the outer element of the socket. In particular, contacting areas of the outer connection element are forced together at a pressure of at least approximately 70 MPa. This high pressure penetrates any metal oxide layers present, and so reduces intermodulation distortion.

Figure 3:
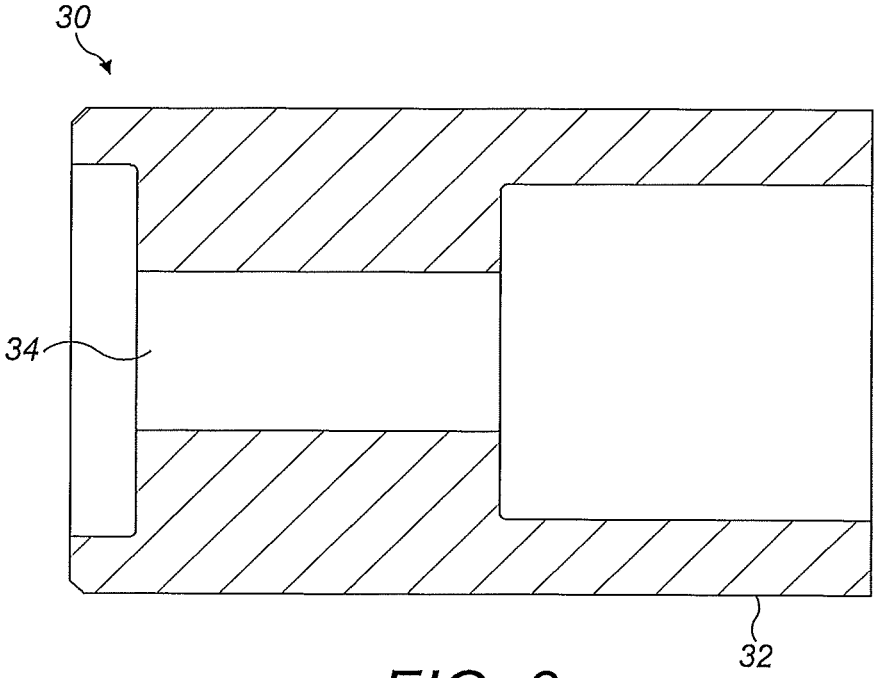

FIG. 3 shows a cross-section through the dielectric 30. The dielectric 30 has a cylindrical outer surface 32 configured to fit closely within the body 20. The dielectric 30 has a cylindrical channel 34 for receiving the pin 40.

The dielectric material is preferably formed from polytetrafluoroethylene (PTFE). The dielectric 30 is a very good electrical insulator. The dielectric 30 isolates the inner and outer connection elements 40,20 of the connector.

Figure 4:
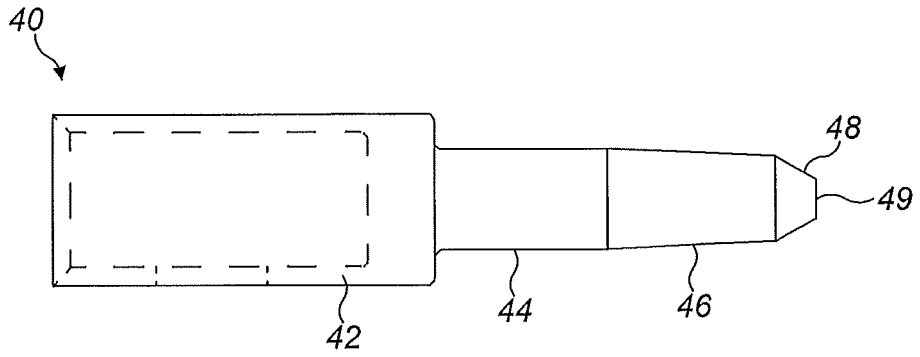
FIG. 4 is a side elevation cross-section of a pin forming part of the plug of FIG. 1.

FIG. 4 is a cross-section of the pin 40. The pin 40 comprises a first section 42, which is cylindrical and configured to fit closely within the cavity 34 of the dielectric 30. The pin 40 further comprises a second section 44, which is configured to engage with the inner connection element of the socket. The second section 44 is cylindrical adjacent the first section 42, with a diameter of between 1.2 and 1.5 mm, and preferably between 1.32 mm and 1.37 mm for a length of approximately 2.3 mm. The second section 44 has a circular cross section. The second section 44 has a first tapered section 46, which tapers at between 1.5° and 3.5°, and preferably at approximately 2.5°. A distal end of the second section 44 comprises a second tapered section 48, which tapers at between 45° and 75°, and preferably at approximately 60° to a longitudinal axis. The second tapered section 48 terminates in a planar distal end 49, extending perpendicular to the longitudinal axis. The planar distal end 49 has a diameter of between 0.3 and 0.7 mm, and preferably 0.44 mm and 0.64 mm.

The pin 40 is formed from beryllium copper. The beryllium copper is plated with a layer of copper plate, preferably between 1 μm and 5 μm, and more preferably 2 μm±1 μm in thickness. A layer of silver plate is then applied onto the copper plate. The silver plate is between 10 μm and 30 μm, and is preferably 15 μm±5 μm in thickness. The plating thickness may have a maximum of 50 μm on corners. The plating materials and thicknesses have been selected to provide optimum conductivity. Due the skin effect, electric current is substantially carried by the outer silver layer.

The exterior surface, and in particular, areas of the pin 40 configured to contact a socket, have a very uniform surface finish. The pin, and in particular, the second section 44 has a surface finish better than 4 μm. More particularly, the surface finish is approximately or better than 1.2 μm. The surface finish is more preferably less than 0.4 μm, in particular on the second section 44. The surface finish is preferably achieved by polishing.

FIG. 5 shows a socket 60 which is a connector according to the present invention. The socket 60 may also be termed a jack receptacle or female connector. The socket 60 is configured to connect with a co-operating plug. The socket 60 is a TNC connector and comprises a body 70, a sleeve 80 and a probe 90. A restraining material 71 prevents longitudinal movement between the body 70 and sleeve 80. The body 70, sleeve 80 and probe 90 are of standard size, and so may be connected to a co-operating plug shown in FIGS. 1 to 4, or to a co-operating known TNC connector. The socket 60 comprises an inner connection element formed by probe 90, and an outer connection element formed by body 70.

Figure 6:
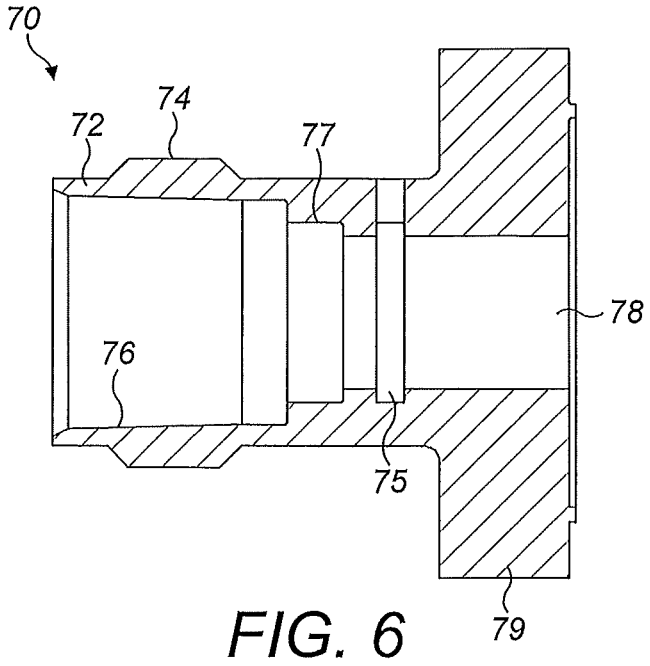
FIG. 6 is a side elevation cross-section of a body forming part of the socket of FIG. 5.

FIG. 6 shows the body 70 of the socket 60. The body 70 has a substantially annular receptacle 72 at a first end. The receptacle 72 is configured to receive the fingers 22 of the plug 10. An interior surface 76 of the receptacle 72 is dimensioned to engage with the profiled ends 28 of the fingers 22. The receptacle 72 tapers inwardly from an open end to a closed end. Preferably, the receptacle 72 tapers smoothly from an interior diameter of between 8.31 mm and 8.46 mm to between 8.10 mm and 8.15 mm.

The body 70 comprises a threaded section 74 on an exterior surface of the receptacle 72. The threaded section 74 is configured to mate with the threaded section 52 of the plug 10.

The body 70 has a cavity 78 for receiving the dielectric 80. The cavity 78 is open to the receptacle 72, along a longitudinal axis of the body 70. The cavity 78 comprises an annular recess 75. The annular recess 75 has a larger interior diameter than the surrounding cavity 78. The cavity 78 is further provided with a stepped cross-sectional area 77 adjacent to the receptacle 72. The body 70 further comprises a flange 79 surrounding the cavity 78. The flange is substantially square when viewed along the longitudinal axis of the body.

The body 70 is formed from an aluminium alloy. Preferably, the aluminium alloy may comprise as % by weight: Si 0.50-0.90, Fe 0.5 max, Cu 3.9-5.0, Mn 0.4-1.2, Cr 0.1, Mg 0.2-0.8, Ni 0.1 max, Zn 0.25 max, Ti & Zr 0.2 max. The body 70 is preferably formed from aluminium because the body is not required to resiliently deform, and the use of aluminium reduces weight. Alternatively, the body may be formed from stainless steel if weight is not critical. The aluminium alloy is plated with a layer of nickel, preferably between 2 μm and 10 μm, and more preferably 5 μm±1 μm in thickness. A layer of silver plate is then applied onto the nickel plate. The silver plate is between 10 μm and 30 μm, and is preferably 15 μm±5 μm in thickness. The plating thickness may have a maximum of 50 μm on corners. The plating materials and thicknesses have been selected to provide optimum conductivity. Due the skin effect, electric current is substantially carried by the outer silver layer.

The surface of the body 70, and in particular, areas of the body 70 configured to contact a plug, have a very uniform surface finish. The body, and in particular, the interior surface 76 of the receptacle 72 has a surface finish better than 4 μm. More particularly, the surface finish is approximately or better than 1.2 μm, 0.4 μm. The surface finish is preferably achieved by polishing.

Figure 7:
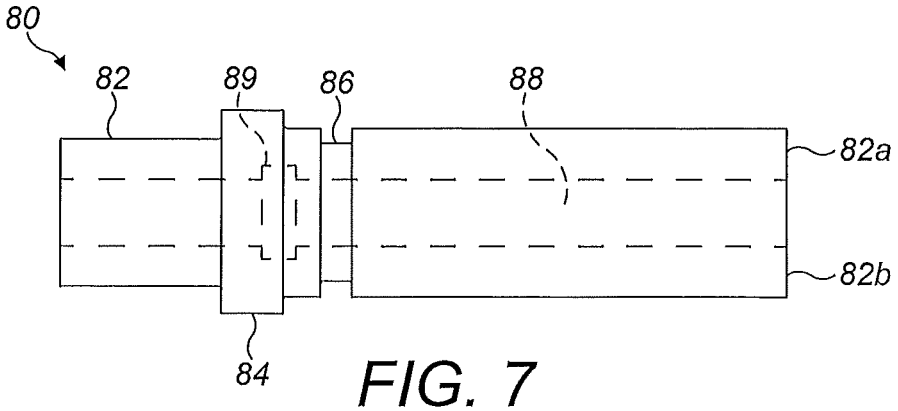
FIG. 7 is a side elevation cross-section of a sleeve forming part of the socket of FIG. 5.

FIG. 7 is a cross-sectional view of the dielectric 80. The dielectric 80 is located within the body 70, and extends through the cavity 78 and into the receptacle 72. The dielectric 80 comprises an annular sleeve 82 at a first end, locatable within the receptacle 72 of the body 70. The sleeve 82 comprises a substantially cylindrical channel 88 extending the length of the dielectric 80. The channel 88 receives the probe 90. The channel has an enlarged section 89 of larger diameter than the remainder of the channel 88.

An outer surface of the dielectric 80 is configured to fit closely within the body 70. The outer surface comprises a ring 84 of larger diameter than the surrounding dielectric 80. The ring 84 is engagable in stepped cross-sectional area 77 of the body 70.

The outer surface of the dielectric 80 also comprises an annular recess 86. The recess 86 in the dielectric 80 is aligned with matching annular recess 75 in the body 70. The aligned recesses 75,86 are keyed together with the restraining material 71 to prevent relative longitudinal movement between the body 70 and dielectric 80. Preferably, the restraining material 71 is a hardening adhesive. The aligned recesses 75,86 are filled with the adhesive. The adhesive may be injected as a liquid, and harden within the aligned recesses 75,86 to a solid.

The dielectric 80 is formed as a split, matched pair of elements 82*a*,82*b*. The dielectric 80 is split longitudinally along a plane to form the two elements 82*a*,82*b*. The separable halves of the dielectric 80 allow the probe 90 to be located within the channel 88.

The dielectric 80 is preferably formed from polytetrafluoroethylene (PTFE). The dielectric 80 is a very good electrical insulator.

FIGS. 8*a* to 8*c* show the probe 90 forming the inner connection element of the socket. The probe 90 is configured to fit in the channel 88 of the dielectric 80. The probe 90 comprises fingers 92 at a first end of the probe, for contact around the pin 40 of the plug 10, to form the inner connection of the male connector. A socket 94 is defined between the fingers 92, the socket 94 configured to receive the pin 40. The socket 94 has a cavity which is between 4.5 mm and 6 mm in length, and is preferably 5.2 mm in length.

The fingers 92 are curved and arranged in an annulus, separated by slits 95. The fingers 92 have a uniform cross-section along their length. Preferably, there are four fingers 92, which are equally spaced and dimensioned.

The probe 90 comprises a collar 96. The collar 96 is configured to engage in the enlarged section 89 of the dielectric 80, to prevent longitudinal movement of the probe 90 within the dielectric 80.

The probe 90 is formed from beryllium copper. The beryllium copper is plated with a layer of copper plate, preferably between 1 μm and 5 μm, and more preferably 2 μm±1 μm in thickness. A layer of silver plate is then applied onto the copper plate. The silver plate is between 10 μm and 30 μm, and is preferably 15 μm±5 μm in thickness. The plating materials and thicknesses have been selected to provide optimum conductivity. Due to the skin effect, electric current is substantially carried by the outer silver layer.

The exterior surface, and in particular, areas of the probe 90 configured to contact the plug, have a very uniform surface finish. The probe, and in particular, the fingers have a surface finish better than 4 μm. More particularly, the surface finish is approximately or better than 1.2 μm. The surface finish may be less than 0.4 μm, in particular on the interior surface of the fingers 92. The surface finish is preferably achieved by polishing.

The probe 90 is formed with the fingers 92 orientated parallel to a longitudinal axis of the probe 90, as shown in FIGS. 8*a* and 8*b*. The fingers 92 are formed with the socket 95 having an internal diameter of between 1.3 and 1.5 mm, and preferably between 1.39 mm and 1.43 mm. The slits 95 having a uniform width of between approximately 0.2 mm and 0.3 mm, preferably between 0.250 mm and 0.275 mm. The slits 95 have a length of between 3.5 mm and 4.5 mm, and preferably 4 mm.

FIG. 8*c* shows part of the probe 90 during manufacture. The fingers 92 are restrained together so that the distal ends of the fingers 92 are brought into contact with each other. The slits 95 are closed at the distal ends of the fingers 92. A distal end of each finger may diverge from the longitudinal axis by a perpendicular distance of between 0.1 mm and 0.3 mm, and preferably between 0.17 mm and 0.22 mm.

The fingers 92 are restrained in this converging position and treated to be permanently deformed to the converging position. Preferably, the fingers 92 are heat treated, preferably for 2 hours at 335° C.±5° C. The fingers 92 are deformed linearly along their length, such that each finger 92 is straight and orientated at an angle to the longitudinal axis of the socket. Following this treatment, the fingers 92 stay in the converging position, until forced radially outwardly by contact with the pin 40. Thus, the fingers 92 extend, by being deformed, in a direction opposite to a direction in which they are urged by a co-operating connector.

The initial converging position provides a very high connection pressure with the inner connection element of the plug. In particular the contacting areas are forced together at a pressure of approximately 70 MPa. This high pressure penetrates any metal oxide layers present, and so reduces intermodulation distortion.

The present invention further provides a method of manufacture of a connector. A connector is formed having an outer connection element or inner connection element having fingers, as described above. The fingers 22,92 are formed extending parallel to a longitudinal axis of the connector. The fingers are restrained at a pre-determined angle to the longitudinal axis of the plug or connector. The fingers are permanently deformed to the angle to the longitudinal axis at which they are restrained. The fingers are deformed by being heat treated, preferably for two hours at 335° C.±5° C. The fingers 22,92 are plated, preferably by electroplating, after the fingers 22,92 have been deformed. In order to plate all surfaces of the fingers 92, the fingers 92 are resiliently urged into extending approximately parallel to the longitudinal axis to be plated. The whole of the plug body and socket probe are plated simultaneously with the integral fingers 22,92.

In use, a plug and socket according to the present invention are connected together by engaging the threaded sections 52,74. Relative rotation between the plug and socket causes the plug and socket to move longitudinally together. The fingers 22 of the plug 10 are forced inwardly by contact with an interior surface of the receptacle 72 of the socket. The fingers 92 of the probe 90 are forced outwardly by contact with the pin 40. Thus, the fingers 22,92 are configured to be urged towards the longitudinal axis when fitted to a co-operating connector. A high pressure contact is made between the inner connection elements 92,40 and the radially outer connection elements 22,72, which provides for low passive intermodulation.

The electrically conducting parts of the plug and socket have been described as plated with silver. Alternatively, the electrically conducting parts of the plug and socket may be plated with gold. Preferably, both the plug and socket are plated with the same metal to avoid distortion caused by dissimilar metal interfaces. A gold layer has the advantage of being resistant to tarnishing. The gold layer is preferably between 2 μm and 10 μm, and more preferably approximately 5 μm thick, and is plated on a layer of nickel, between 4 μm and 15 μm, and preferably of approximately 8 μm thickness.

The base material for the conducting parts of the plug and the socket probe has been described as beryllium copper. Alternatively, the base material for any of these conducting parts may be aluminium or an aluminium alloy. The base material for the socket body has been described as an aluminium alloy. Alternatively, the base material of the socket body may be beryllium copper. The base material may be coated with any suitable first layer (e.g. copper, nickel) to allow a further conducting layer (e.g. silver, gold) to affix to the base material.

The plug and socket connectors described are preferably used together in a connector pair to minimise passive intermodulation distortion. Alternatively, one of the plug or socket may be used with a standard TNC connector. The distortion produced using a connector according to the present invention with a standard TNC connector will be lower than when using two standard TNC connectors.

The fingers 22,92 have been described as extending at an angle to the longitudinal axis of the plug or socket. Alternatively, the fingers 22,92 may extend substantially parallel to the longitudinal axis. The low PIM may be provided by the profiled ends of the fingers 22, and/or the surface finish, and/or any of the features described above.

The plug and socket are described having dimensions within particular ranges. A selection of dimension in one of the plug and socket may require a particular dimension in the other of the plug and socket to allow co-operation. The connectors have been described as TNC connectors, which may be joined by threaded sections. Alternatively, the connectors may be BNC (Bayonet Neill-Concelman) joined by bayonet mounts. Alternatively, the connectors may be any other type of connector utilising a plurality of fingers to engage with a co-operating part.

Any details not described may be the same as on a standard TNC connector. All dimensions are stated including plating. Any of the features described may be used on any embodiment, and in particular, may be used on either the socket or plug.

The invention claimed is:

1. A connector comprising:

an outer connection element; and an inner connection element;

wherein one of the outer connection element and the inner connection element comprises a plurality of fingers extending at an angle relative to a longitudinal axis of the connector, the plurality of fingers being formed and subjected to heat treating while deformed at the angle, wherein the heat treatment of the deformed fingers is such that the deformation of the fingers is made permanent and the fingers are permanently deformed to extend at the angle to the longitudinal axis; and wherein contacting areas of the inner connection element and/or outer connection element are configured to exert a pressure such that, when applied on a co-operating connector, a level of $5^{th}$ order passive intermodulation will be produced by the connector which is less than −145 dBm at frequencies between 1 and 2 GHz for two 50 W carriers.

2. The connector as claimed in claim 1, wherein the fingers of the inner connection element are plated while urged apart, following the heat treating of the inner connection element.

3. The connector as claimed in claim 1, wherein the inner connection element or outer connection element are formed from beryllium copper, and plated with silver or gold.

4. The connector as claimed in claim 2, wherein the silver is plated to a thickness of between 10 μm and 30 μm, or the gold is plated to a thickness of between 2 μm and 10 μm, and/or a surface of the fingers for contacting a co-operating connector is polished to 1.2 μm or better.

5. A co-operating connector in combination with the connector according to claim 1.

6. A method of manufacturing a connector comprising:

forming an outer connection element or inner connection element having fingers;

deforming the fingers to extend at an angle to a longitudinal axis of the connector; and heat treating the connection element while the fingers are deformed at the angle to the longitudinal axis, wherein the heat treatment of the deformed fingers is such that the deformation of the fingers is made permanent and the fingers are permanently deformed to extend at the angle to the longitudinal axis;

wherein heat treating the connection element includes heat treating the connection element for at least 2 hours at a temperature between 330° C. and 340° C.

7. The method as claimed in claim 6, comprising:

plating a surface of the fingers for contacting a co-operating connector to 1.2 μm or better.

8. The method as claimed in claim 6, comprising:

plating the fingers following the heat treating of the connection element.

9. The method as claimed in claim 6, comprising:

initially forming the fingers extending substantially parallel to the longitudinal axis of the connector.

10. The method as claimed in claim 6, comprising:

forming the inner connection element or outer connection element from beryllium copper.

11. The method as claimed in claim 8, comprising:

plating the inner connection element or outer connection element with silver or gold.

12. The method as claimed in claim 11, wherein the silver is plated to a thickness of between 10 μm and 30 μm, or the gold is plated to a thickness of between 2 μm and 10 μm.

13. The method as claimed in claim 11, wherein the silver is plated to a thickness of 15 μm±5 μm, or the gold is plated to a thickness of 5 μm±2 μm.

14. The method as claimed in claim 6, wherein the connector is a plug, and the fingers form the outer connection element, wherein the method comprises deforming and heat treating the connection element, including the fingers, such that the fingers diverge at an angle relative to the longitudinal axis.

15. The method as claimed in claim 13, wherein a distal end of the fingers diverges from the longitudinal axis by a lateral distance of between 0.5 mm and 1 mm.

16. The method as claimed in claim 13, wherein the outer connection element comprises twelve fingers arranged in an annulus.

17. The method as claimed in claim 6, wherein the connector is a socket, and the fingers form the inner connection element, wherein the method comprises deforming and heat treating the fingers to converge at an angle relative to the longitudinal axis.

18. The method as claimed in claim 15, wherein the fingers are plated while urged apart, following the heat treating of the inner connection element.

19. The method as claimed in claim 17, wherein a distal end of the fingers converges from the longitudinal axis by a lateral distance of between 0.1 mm and 0.3 mm.

20. The method as claimed in claim 17, wherein the inner connection element comprises four fingers.

21. The method as claimed in claim 6, wherein the connector is a TNC connector and comprises a threaded portion to mate with a threaded portion of a co-operating TNC connector.

22. A connector manufactured according to the method of claim 6.

23. The method as claimed in claim 6, wherein forming the outer connection element or inner connection element comprises forming the fingers to extend along the longitudinal axis and parallel to each other.

* * * * *